US005547726A

United States Patent [19]

Dingler

[11] Patent Number: 5,547,726

[45] Date of Patent: Aug. 20, 1996

[54] CONSTRUCTION ELEMENT

[76] Inventor: Gerhard Dingler, 7274 Haiterbach 1, Schillerstrasse 49, Germany

[21] Appl. No.: 44,988

[22] Filed: Apr. 8, 1993

Related U.S. Application Data

[63] Continuation-in-part of Ser. No. 526,515, May 21, 1990, abandoned.

[30] Foreign Application Priority Data

May 24, 1989 [DE] Germany ..... 39 16 938.3

[51] Int. Cl.[6] ..... B32B 3/00

[52] U.S. Cl. ..... 428/57; 52/309.1; 52/309.16; 52/659; 52/DIG. 7; 106/643; 428/58; 428/68; 428/76; 428/323; 428/328; 428/362; 428/902; 428/903.3

[58] Field of Search ..... 428/68, 76, 57, 428/58, 323, 328, 362, 902, 903.3; 52/729, 309.1, 309.16, 736, 659, DIG. 7, 733; 524/439, 440, 441; 106/643

[56] References Cited

U.S. PATENT DOCUMENTS

| | | | |
|---|---|---|---|
| 768,983 | 8/1904 | Dunn | 106/643 |
| 3,166,518 | 1/1965 | Barnard | 106/643 |
| 3,728,211 | 4/1973 | Ball | 524/439 |

*Primary Examiner*—Nasser Ahmad

[57] ABSTRACT

A construction element has the dimensions of formwork panel sheets of elemental concrete formwork and a thickness substantially less than at least one of its other dimensions. In terms of weight, the construction element is comprised of more than 50% plastic and less than 50% small, thin pieces of metal. The pieces of metal are distributed statistically evenly in the plastic, shorter than the construction element is thick, and preferably made of aluminum. The thermal transfer coefficient of the construction element is at least that of wood/plastic casting boards.

49 Claims, 3 Drawing Sheets

CONSTRUCTION ELEMENT

This is a continuation-in-part of patent application Ser. No. 07/526,515 filed May 21, 1990 of the same inventor, now abandoned.

The invention relates to construction elements having a thickness substantially less than at least one of its other dimensions.

BACKGROUND OF THE INVENTION

Such construction elements may, for example, have the form of sheets or boards. They may be employed in particular in the field of concrete formwork. If they have the form of sheets, they have a thickness of about 12–23 mm, a length in the range of around 60 cm to 6 in and a width of around 20 to 250 cm. These sizes vary from manufacturer to manufacturer. The dimensional details give an idea in which size range the construction elements are used if they are sheets. Broadly speaking, it may be said that length and width vary in order of magnitude in the lower meter range or decimeter range.

If the construction elements are boards, in principle the dimensions are in the same range. Such boards have thicknesses in the centimeter range, lengths in the lower meter range and widths in the lower decimeter range. Boards are used in the construction industry, for example for timber formwork girders, for example H girders. However, they may also be fixed as textured boards in front of the formwork frame. However, they may also be used as boards which make the bottom boards or the side boards on console balustrades.

Sheets are virtually always made up of a plurality of layers such as plywood and provided with a protective film. What is said below with regard to composite formwork sheets generally applies analogously in very many areas to plywood sheets:

1. The sheet expands differently in different directions when heated.
2. If film laminated sheets are subjected to high temperature loads, blistering and detaching effects occur.
3. It is difficult to make the surface repellent to cement paste. The surface loses these repelling properties over time, which is why separate cleaning installations and cleaning machines are necessary.
4. Release agents have to be used.
5. The use of vibrators may cause surface destruction, either by the vibrator touching the sheet directly, or else by the vibrator making the film layer undergo very short oscillations which cannot be absorbed by the bonding joint over long periods and therefore results in detachment. This risk exists in particular in the case of ceiling formwork.
6. The sheets absorb moisture and therefore change their shape after installation.
7. Mechanical damage pierces the film and brings about a loss in load-bearing capacity.
8. The sheets may rot due to decay or fungal attack.
9. The abrasion resistance is not the same over the cross-section, since the material is not homogeneous.
10. Textured sheets have a short service life and are difficult to produce.
11. It is difficult to repair sizeable drill holes in or damage to the formwork skin.

12. The boards are only roughly classified according to load-bearing capacity and modulus of elasticity. They cannot be adequately matched in accordance with use.
13. Recycling is not possible.
14. It is not possible to fix the shape to within tenths of a millimeter.
15. Since the edges are interfaces, they have to be sealed.
16. An elastic joint has to be produced by means of silicone between the nose of the frame leg and the formwork skin.
17. Plastic cones have to be fitted as edge protection.
18. The screws which fix the sheet to the frame cannot be screwed in completely because allowance must be made for the swelling of the sheet. Consequently, the fixing screws initially protrude, which presents difficulties in transportation and impairs the concrete finish.
19. The surface cannot be easily regenerated.
20. The service life is not long enough.
21. The sheets have to be dip-impregnated.
22. Allowance has to be made for the fact that timber will only withstand a certain amount of pressure while the metal supports would allow much higher pressure.
23. Edges can split. In the case of boards in particular, the ends splay.
24. In principle it is impossible to use recycled materials for production.
25. The sheets and boards must be stored protected from the weather.
26. Production is complicated. Modern processes such as compression molding or extrusion are not possible.
27. If the construction element absorbs moisture, the load-bearing capacity fluctuates.
28. The sheets become disproportionately expensive with increasing size of their surface area. However, at the same time there has been a trend for some time to use large-area formwork elements.
29. When fitting the sheets in the frame, the longitudinal and transverse directions have to be considered, since they have different moduli of elasticity even in the case of plied sheets.
30. When fixing sheets having a very high load-bearing capacity, a hole for the screw has to be predrilled in order to prevent the film tearing.

OBJECT AND STATEMENT OF THE INVENTION

The object of the invention is to provide a construction element to replace sheets and boards that is very simple to produce and thus inexpensive. The fixing aids in use, such as nails and screws, are to continue to be used; similarly, it must be possible to retain previous drilling techniques. The disadvantages mentioned above are to be at least substantially eliminated.

According to the invention, these objects are achieved by:

A building construction element of which the thickness dimension is substantially less than at least one of its other dimensions, having the following features:

a) in terms of weight, the construction element comprises more than 50% plastic and less than 50% small, thin pieces of metal;

b) the pieces of metal are statistically evenly distributed in the plastic;

c) the pieces of metal are shorter than the construction element is thick;

d) the construction element has the dimensions of formwork panel sheets of elemental concrete formwork; and e) the thermal transfer coefficient of the construction element is at least that of wood/plastic casting boards.

As used in this specification and in the poured concrete industry, "elemental" means "modular". Several elemental frames may be combined in sophisticated forms.

The wood/plastic casting boards of the prior art are multi-layers of wood bonded together by plastic in a multi-layer sandwich. The wood/plastic casting boards are used in elemental or non-elemental frames.

The small, thin pieces of metal may be pieces of metal strip, as well as metal chips, metal turnings, metal shavings, metal cuttings, metal clippings and generally small, thin metal waste products. Preferably, the pieces of metal are made of an aluminum alloy or aluminum foil.

By mixing-in small, thin pieces of metal, the plastic which is unusable in itself is given the necessary properties to impose high industrial and commercial requirements on such construction elements.

Using aluminum alloy pieces of metal or aluminum foil saves weight and imparts certain other beneficial properties. Thermal conductivity influences to a great degree the compression time and the setting behavior of the concrete. The thermal conductivity is determined exclusively by the concentration of pieces of metal. With a proportion of 15% aluminum pieces, values of a comparable timber or wood/plastic sheet are obtained. The good thermal conductivity produces quite uniform cooling of the construction element, with the result that no stresses are implanted. This guarantees a warp-free form in the cooled state.

The described embodiments include the following additional advantageous features:

The thermal transfer coefficient of the construction element is equal up to about three times that of wood/plastic casting boards. Preferably the thermal transfer coefficient is equal to between two and three times that of wood/plastic casting boards.

The plastic is thermoplastic. As a result, the construction element can be produced more easily and can be recycled better when it is worn. This would not be possible with thermoset plastics.

The plastic includes all thermoplastics, duroplastics, monomeres and polymers that, for example, by thermal and/or chemical and/or physical processes, are reshapable.

The plastic is, at least in large proportion, recycled thermoplastic. The proportion of recycled thermoplastic is 70%–100%. As a result, the problem of waste disposal in the plastic sector is alleviated. So much material is generated here that companies are happy if the material is fetched and they do not have to pay dumping fees. This feature reduces costs enormously, so that the construction element becomes cheaper than wood, from this aspect whether solid wood or plywood.

The plastic comprises at least 30%–50% olefins. The result is of value in particular in the construction industry. The cement then adheres even less to the plastic.

Less than 5%–20% by weight of the plastic has plasticizer. As a result, the properties of the construction element are little changed or not changed at all by migrating of the plasticizers.

The pieces of metal can be metal chips. As a result, the pieces of metal can be produced in a simple way. The surface of such chips is, of course, naturally very cracked and rough and, seen microscopically, uneven. As a result, they bond intimately with the plastic.

The chips can be those generated in metal-cutting machining. As a result, the construction element is, furthermore, inexpensive. A contribution is made to disposal. The metal-cutting industry is happy if it knows where it can send its chips.

The chips can be ribbon chips, snarl chips, flat helical chips, cylindrical helical chips, spiral helical chips or spiral chips. Such chips are generated as scrap in industrial production. Depending on the desired properties of the construction element, one type of chip, several types of chips or else all types of chips may be used in various proportions by weight.

The chips can be about 0.5 mm to 5 mm thick and a multiple of their thickness long, more particularly 0.5 mm to 3 mm thick, in particular 1 to 2 mm thick. The chips are from several millimeters to about the thickness of the construction element long, more particularly about 3 to 20 mm long, in particular at least 4 mm long. These chip dimensions have proved very successful in tests for construction elements in the construction industry.

The pieces of metal may be composed of steel instead of aluminum alloy. This allows use of pieces generated very frequently in industry as waste or scrap. Furthermore, little steel is required to improve the characteristic properties of the construction elements.

The steel can be stainless steel. As a result, still better strength and resistance of the metal component to alkalis, acids or the like are achieved.

The pieces of metal are degreased. This improves adhesion between plastic and metal.

The pieces of metal can have a primer coating on their surface. This also improves adhesion between plastic and metal. Corrosion resistance also is improved.

The primer coating can be a chromating primer coating or a phosphating primer coating. These coatings are successfully tried primer coatings.

The pieces of metal can include a mixture of different metals. This allows properties such as can never be provided by timber with its natural conditions of growth to be imparted to the construction element.

The mixture can comprise pieces of aluminum alloy and steel. This is a particularly successfully tried mixture that is also cheap. This mixture lies in the range of about 30 percent by weight aluminum alloy and about 10 to 20 percent steel.

The construction element may consist of at most 30 percent by weight metal pieces and at least 70 percent by weight plastic. The plastic comprises other plastic apart from olefins to a maximum of about 50% plus 2%, minus 60% The construction element has a modulus of elasticity of between several hundred $N/mm^2$ to about 20,0000 $N/mm^2$, more particularly, a lower limit of the modulus of elasticity is above 500 $N/mm^2$. In particular, the lower limit of the modulus of elasticity is 900 $N/mm^2$. These data were obtained in tests and have been tried in practice.

The construction element contains mineral fiber additives, in particular, glass fibers. This improves the properties of the construction element with respect to compression. Compression in the material occurs of course when the construction element is bent, to be precise in the region of relatively small curvature.

The construction element can contain colorants. This allows characteristic properties of the construction element to be indicated by the color.

The construction element can be pressed to form in a compression mold. This compacts the material and thus improves certain characteristic properties.

The construction element can be extruded. This allows the construction element to be produced continuously.

The construction element has a plastic surface that is resistant to acid and alkaline solutions in the range of about pH 2 to 14. This allows the construction element to be employed in a broad range of applications. Depending on the selection of plastic, other resistances are obtained.

More particularly, the construction element can be resistant to alkaline solutions in the range of about pH 12 to 14. This is particularly important for the construction industry, because the pH of cement slurry is 13.3.

The construction element can be fitted in girders of the form of timber formwork girders. These construction elements are a large area of application for the invention. The girders can be H girders and the like.

A plurality of construction elements can be welded to one another, side by side. This avoids the technical difficulties and high costs of very large construction elements.

A plurality of sheets can be welded to one another, side by side. This allows smaller, inexpensive sheets to be joined together into large sheets, which are much less expensive than the previous large sheets of plywood. The process for the production of such sheet-like elements is self-evident from the above features to an average person skilled in the art.

The construction element can be used as replacement for formwork sheets of wood and timber boards for the production of girders. Such use would give an entire branch of industry fresh innovative impetus. The girders can be H girders and the like.

The construction element has a textured relief on one side. This makes it easy to produce textured reliefs that are also durable. It is known that a principal objection to concrete walls is their unbroken flatness.

A process for heating the construction element involves radiating the construction element contactlessly with electromagnetic waves.

DESCRIPTION OF THE DRAWINGS

Preferred exemplary embodiments of the invention are now described, taken together with the drawings in which.

DETAILED DESCRIPTION OF PREFERRED EMBODIMENTS

The wood/plastic casting boards known to the art have for instance 11 layers bonded together. The wood layers are bonded together by intermediate plastic layers. The following chart shows table values of heat conductivity, measured in Watts per meter and Degrees Kelvin for various materials and measured values of heat conductivity for (1) a construction element according to the invention, (2) a dry 11 layer wood/plastic casting board and (3) a wet 11 layer wood/plastic casting board.

As can be seen, the Thermal Conductivity (Thermal Transfer Coefficient) of the construction element according to the invention is up to three times greater than wet wood/plastic casting boards and two times greater than dry wood/plastic casting boards.

| Material | λ in W/m K. |
|---|---|
| Table Values | |
| Polyethlyene - High Density | 0.4 |
| Polyethylene - Low Density | 0.32 |
| Polypropylene | 0.17 |
| Polyamide 6 | 0.23 |
| Polyamide 6 - GF 25 | 0.26 |
| Polyamide 6 - GF 30 | 0.28 |
| Polyamide 6.6 | 0.23 |
| Glass | 0.72 |
| Aluminum | 175.85 |
| Steel | 52 |
| Concrete | 1.2 |
| Water | 0.55 |
| Air | 0.026 |
| Oak | 0.166 |
| Pine | 0.092 |
| Measured Values | |
| Present Invention | 0.320 |
| Wood, dry 11 layers | 0.132 |
| Wood, wet 11 layers | 0.119 |
| Polyethylene - Low Density | 0.329 |

λ = Thermal Transfer Coefficient in Watts per meter and Degree Kelvin

Figure 1:
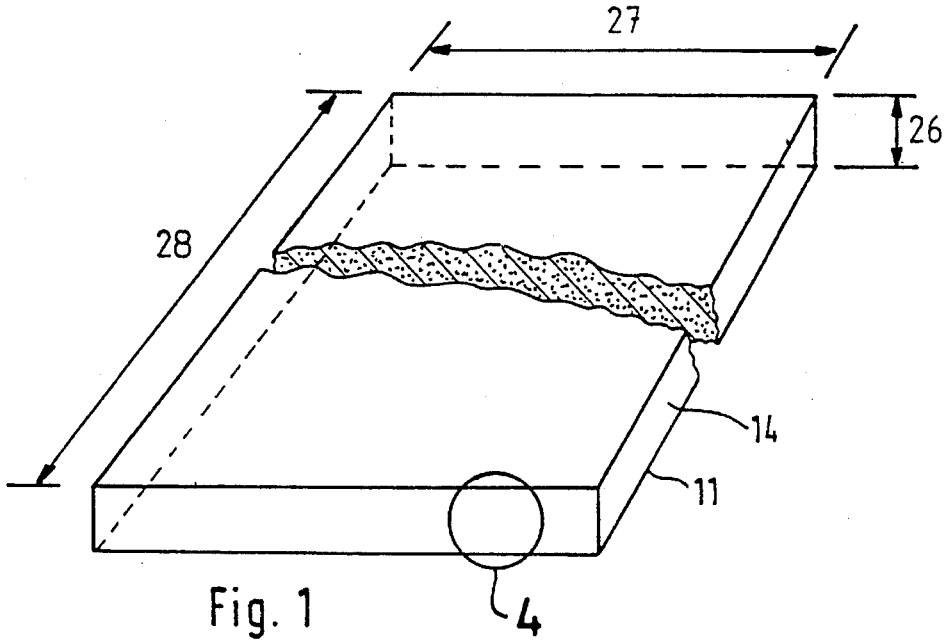
FIG. 1 shows a perspective view of a sheet according to the invention.

Referring to FIG. 1, sheet 11 is 9 cm thick, around 2.60 m long and around 1.35 m wide. it contains 10% aluminum chips, 10% steel chips and 5% chopped glass fiber, the latter to increase the shear strength. The plastic is recycled thermoplastic, which was granulated beforehand and substantially consists of polyolphins. The evenly distributed mixture was introduced into a mold to produce the sheet 11. The mold had a temperature between 150° and 200° C. with a best temperature value around 180° C. The mixture remained in the mold for about 6 minutes. The compression mold was cooled. The specific pressure used in compression was between 250 $N/mm^2$ and 550 $N/mm^2$, with a pressure at the optimum in the range from 300 to 330 $N/mm^2$. The molding pressure was generated by a male mold, which exerts a pressure on one of the major surfaces of the sheet 11, perpendicularly to said surface.

Reference numeral 26 in FIG. 1 denotes the thickness of sheet 11, whereas 27 is the width and 28 is the length of sheet 11. The thickness 26 is substantially less than both of the other dimensions.

Figure 2:
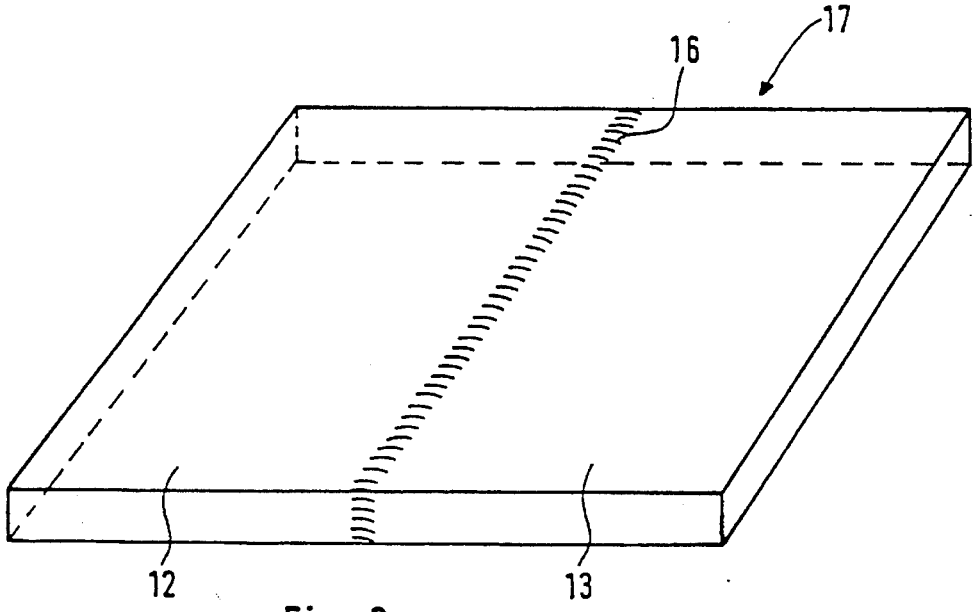
FIG. 2 shows a perspective view of two sheets welded together.

FIG. 2 shows two sheets, 12, 13 of this type, which has been connected abutting each other with their one end face 14 by a weld 16. The weld 16 has been ground down again after welding, to the extent that it protruded beyond the surface limitations of the sheets 12, 13. Consequently, a new sheet 17, with the approximate dimensions 2.60×2.60 m, is produced.

Figure 3:
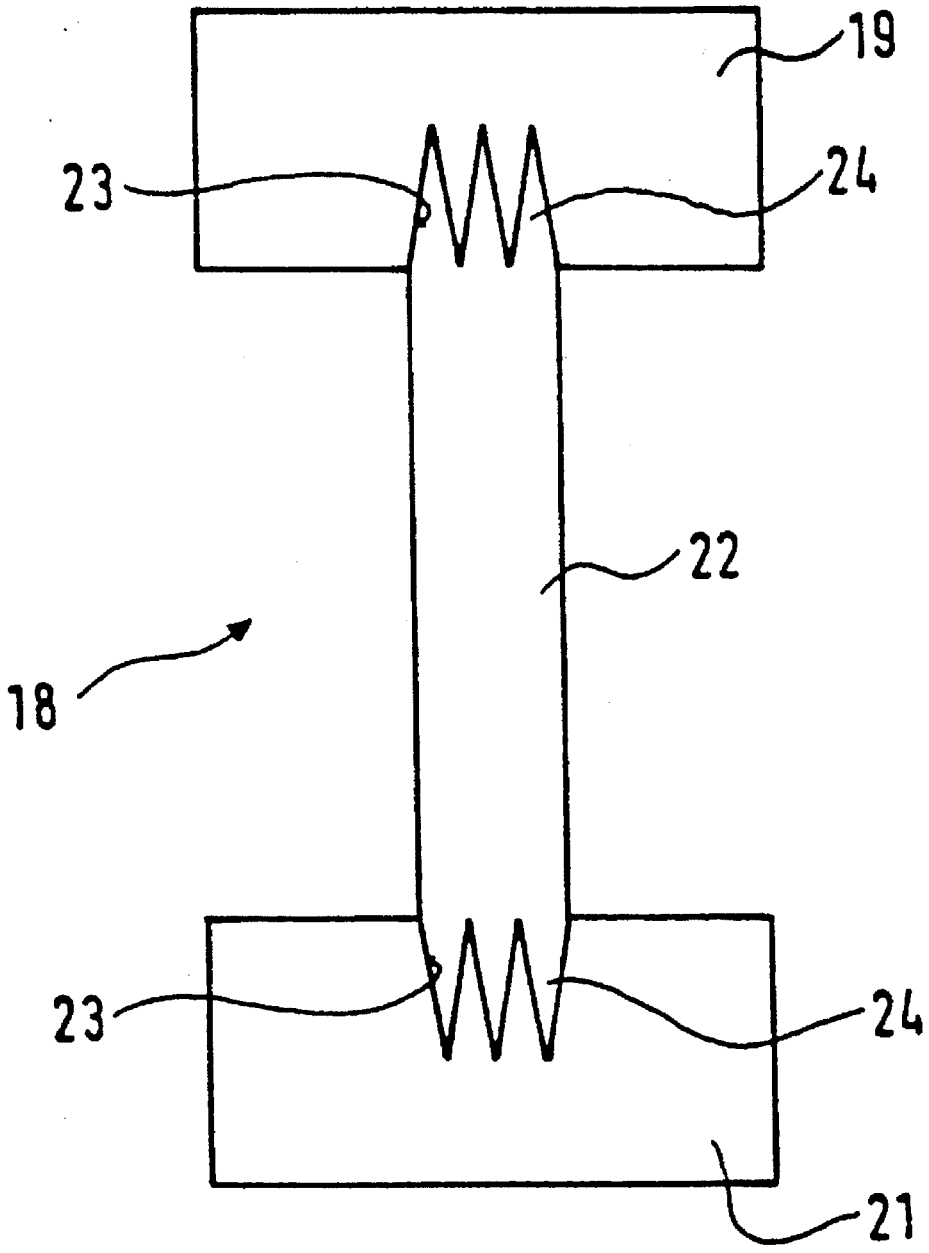
FIG. 3 shows the end-on view of an H girder.

FIG. 3 shows an H girder 18 frequently used in the construction trade.

Said girder can be produced either as an integral construction element or else boards 19, 21, 22 are produced. The boards 19, 21 are given jointing grooves 23 in their mutually facing central region and the board 22 is given jointing tongues 24 on its ends. The connection of groove and tongue is carried out by gluing, welding or the like.

Such an H girder 18 can be produced in the standard lengths 2.45 m, 2.90 m, 3.60 m, 3.90 m, 4.90 m, 5.90 m etc. Its characteristic values are as follows: M allow. better than 5.0 kNm, Q allow. better than 11.0 kNm, weight less than 5 kg/m. The height of the H girder 18 is, for example, 20 cm and the width of the boards 19, 21 is 8 cm.

Boards may also be designed in such a way that they provide the formwork skin, for example for ceiling formwork, together with the H girders.

Consequently, they can, for example, replace the 22 mm thick so-called 3-S three-layer sheets and can then have sheet sizes of 50/200 cm, 100/200 cm, 50/250 cm and 100/250 cm. However, the sheets may also be employed for formwork panels such as are used in the case of automatic climbing systems.

The construction elements produced by the invention have the advantage of being dimensionally accurate to the tenth of a millimeter and of remaining so.

If timber beams, timber panels or like construction elements consisting of wood hit a hard floor on their edge, the edge splays. Therefore, a special edge protection is frequently used in such cases. The invention does not require such edge protection. The invention preferably employs HDPE (high density polyethylene), of which the density is greater than 0.93 and which, taken by itself (that is to say without the pieces of metal) has a modulus of elasticity of up to E–1,500 N/mm$^2$.

In principle, LDPE (low density polyethylene) having a density of less than 0.93 may also be used, the modulus of elasticity then being 170 N/mm$^2$ and less.

The construction elements can also be produced by the extrusion process. This applies in particular to construction elements that have a bar-shaped form, such as for example the girders according to FIG. 3. However, sheets and boards can also be extruded. In that case, as with all extrusion processes—the material is subsequently cut to size. However, the die ring of the extruder has to be followed by a pressure chamber, in which the material remains until it is solid. Such a chamber may be closed, for example 8 m long, and the material is then cut off in the chamber once it has hardened. The chamber is then only opened to remove one or more sections.

However, the chamber may also be provided in its wall region lying opposite the die ring of the extruder with a clearance corresponding to the outline of the extruded material, so that the extruded material passes continuously through this opening to the outside. In this case, the material can be cut off under atmospheric pressure. Then, the gap between the chamber opening and the material must of course be sealed.

In the construction element there are of course pieces of metal which are, seen statistically, evenly distributed and are thin even in relation to the construction element. The metal pieces can be utilized to heat the construction element. If the construction element is a formwork sheet for concrete formwork, it is then possible, for example, to carry out construction during the winter by supplying electromagnetic energy contactlessly to the pieces of metal. This can be carried out, for example, by means of microwave generators, such as are known for example from microwave ovens, or by the induction principle, as is known both in industry and in the household. In such application cases, such electromagnetic transmitters must be provided on the outer side of the formwork, away from the concrete, and irradiate the formwork panels with the waves. This has the advantage that the construction elements remain free from electric voltage.

Figure 4:
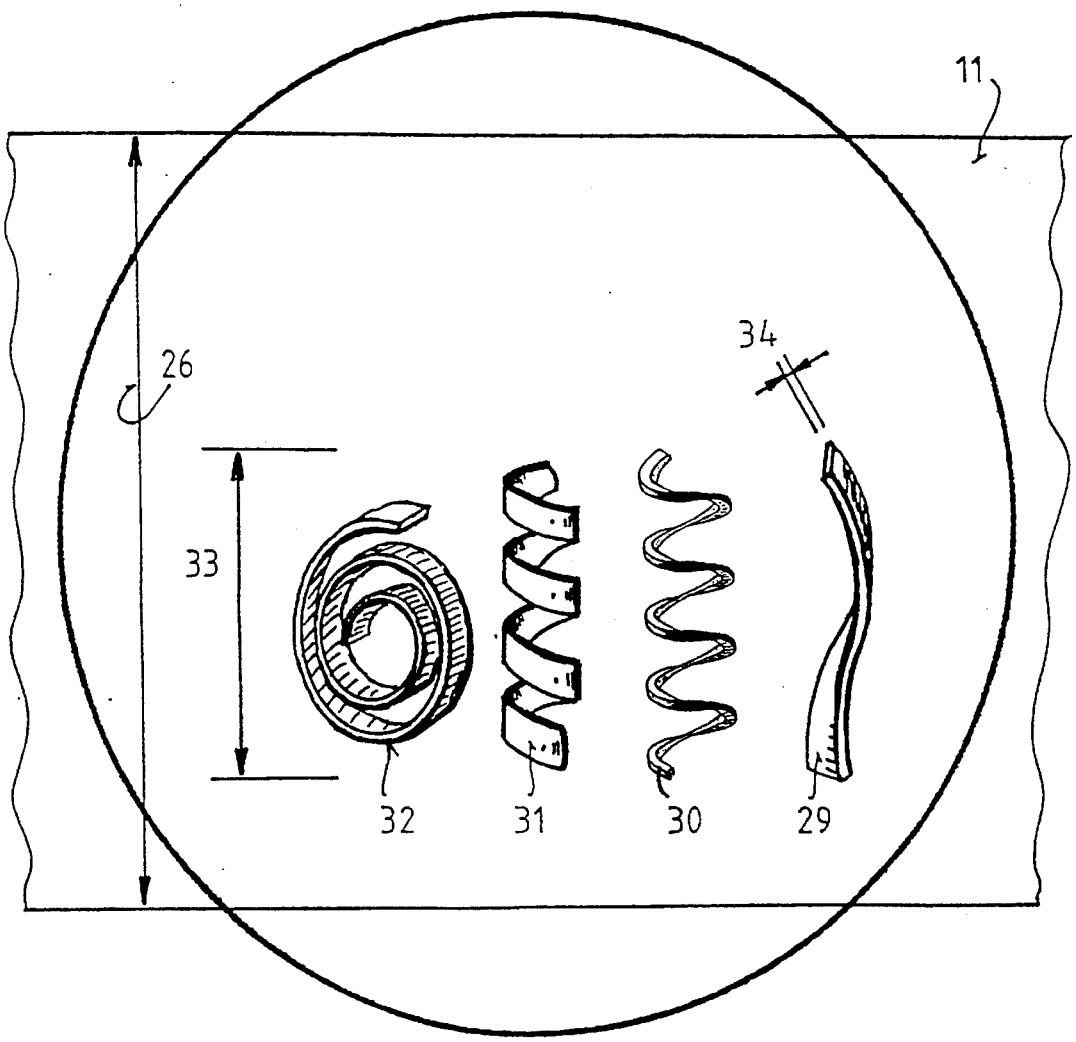
FIG. 4 shows examples of metal chips used in the construction element according to the invention.

Usable chips can be taken from the book "Fertigungsverfahren", (Production Processes), Volume 1 by Konig, VDI-Verlags GmbH, page 183, in particular FIG. 6–24. These chips are shown in FIG. 4. According to FIG. 4 several examples of chips are depicted, namely a ribbon chip 29, a flat helical chip 30, a cylindrical helical chip 31 and a spiral helical chip 32. The chips in their three-dimensional form occupy a length (in their greatest extension) denoted with reference numeral 33, which length is shorter than the thickness 26 of sheet 11. Reference numeral 34, for example, denotes the thickness of the ribbon chip 29. It is to be understood that not necessarily all types of metal pieces or chips are to be used in a single mixture. The metal pieces are oriented in an irregular manner; the shown orientation and distribution density, of course, is not representative of the real composite structure.

What is claimed is:

1. A building construction element of which the thickness dimension is substantially less than at least one of its length and width dimensions, having the following features:

a) in terms of weight, the construction element comprises more than 50% by weight plastic and less than 50% small pieces of metal selected from the group consisting of aluminum foil and aluminum alloy, the construction element being comprised predominantly of the plastic and the pieces of metal;

b) the pieces of metal are oriented irregularly and essentially evenly distributed in the plastic;

c) the pieces of metal have a longest dimension that is less than the construction element is thick;

d) the construction element has the dimensions of formwork panel sheets of elemental concrete formwork; and e) the thermal transfer coefficient of the construction element is at least that of multilayer casting boards made of a plurality of layers of wood bonded by intermediate layers of plastic.

2. A building construction element of which the thickness dimension is substantially less than at least one of its length and width dimensions, having the following features:

a) in terms of weight, the construction element comprises more than 50% by weight plastic and less than 50% by weight small pieces of metal, the construction element being comprised predominantly of the plastic and the pieces of metal;

b) the pieces of metal are oriented irregularly and essentially evenly distributed in the plastic;

c) the pieces of metal have a longest dimension that is less than the construction element is thick;

d) the pieces of metal are selected from the group consisting of aluminum foil and an aluminum alloy; and e) the thermal transfer coefficient of the construction element is at least that of multilayer casting boards made of a plurality of layers of wood bonded by intermediate layers of plastic.

3. A building construction element as claimed in claim 1, wherein said pieces of metal have a crinkled or crumpled surface.

4. A building construction element as claimed in claim 1 wherein said pieces of metal have a three dimensional configuration.

5. A building construction element as claimed in claim 3, wherein said pieces of metal are substantially flat in cross-section.

6. A building construction element as claimed in claim 1, wherein said plastic is a thermoplastic.

7. A building construction element as claimed in claim I, wherein said plastic is thermoplastic material.

8. A building construction element as claimed in claim 1, wherein said plastic comprises reshaped plastic according to at least one of thermal, chemical and physical processes.

9. A building construction element as claimed in claim 6, wherein said plastic is, at least in large proportion, recycled thermoplastic.

10. A building construction element as claimed in claim 9, wherein said proportion of recycled thermoplastic is 70%–100% by weight.

11. A building construction element as claimed in claim 6, wherein said plastic is comprised of at least 30% by weight olefins.

12. A building construction element as claimed in claim 11, wherein said plastic is comprised of at least 40% by weight olefins.

13. A building construction element as claimed in claim 11, wherein said plastic comprises at least 50% by weight olefins.

14. A building construction element as claimed in claim 1, wherein less than 20% by weight of said plastic has plasticizer.

15. A building construction element as claimed in claim 14, wherein less than 10% by weight of said plastic has plasticizer.

16. A building construction element as claimed in claim 15, wherein less than 5% by weight of said plastic has plasticizer.

17. A building construction element as claimed in claim 1, wherein said pieces of metal comprise metal chips.

18. A building construction element as claimed in claim 17, wherein said metal chips are metal chips generated in metal-cutting machining.

19. A building construction element as claimed in claim 18, wherein said metal chips are metal chips selected from the group consisting of ribbon chips, snarl chips, flat helical chips, cylindrical helical chips, spiral helical chips and spiral chips.

20. A building construction element as claimed in claim 17, wherein said metal chips have a thickness of about 0.5 mm to 5 mm and a length that is a multiple of their thickness.

21. A building construction element as claimed in claim 20, wherein said metal chips are about 0.5 to 3 mm thick.

22. A building construction element as claimed in claim 20, wherein said metal chips are about 1 to 2 mm thick.

23. A building construction element as claimed in claim 17, wherein said metal chips have a length from approximately three millimeters to about the thickness of said construction element.

24. A building construction element as claimed in claim 23, wherein said metal chips are about 3 to 20 mm long.

25. A building construction element as claimed in claim 23, wherein said metal chips are at least 4 mm long.

26. A building construction element as claimed in claim 1, wherein said pieces of metal comprise aluminum foil.

27. A building construction element as claimed in claim 1, wherein said pieces of metal are degreased pieces.

28. A building construction element as claimed in claim 1, wherein said pieces of metal have surfaces with a primer coating.

29. A building construction element as claimed in claim 28, wherein said primer coating is a chromating primer coating.

30. A building construction element as claimed in claim 28, wherein said primer coating is a phosphating primer coating.

31. A building construction element as claimed in claim 1, wherein said pieces of metal comprise a mixture of different metals.

32. A building construction element as claimed in claim 1, wherein said construction element comprises at most 30 percent by weight metal chips and at least 70 percent by weight plastic.

33. A building construction element as claimed in claim 11, wherein said plastic is comprised of 49% to 80% olefins.

34. A building construction element as claimed in claim 1, wherein said construction element has a modulus of elasticity of between approximately 500 n/mm$^2$ and about 20,000 N/mm$^2$.

35. A building construction element as claimed in claim 34, wherein the lower limit of said modulus of elasticity is above 500 N/mm$^2$.

36. A building construction element as claimed in claim 35, wherein said lower limit of said modulus of elasticity is 900 N/mm$^2$.

37. A building construction element as claimed in claim 1, further comprising mineral fiber additives.

38. A building construction element as claimed in claim 37, wherein said mineral fiber additives are glass fibers.

39. A building construction element as claimed in claim 1, further comprising colorants.

40. A building construction element as claimed in claim 1, wherein said construction element is a formed-in-a-compression mold construction element.

41. A building construction element as claimed in claim 1, wherein said construction element is in an extruded form.

42. A building construction element as claimed in claim 1, wherein said construction element has a plastic surface that is resistant to acid and alkaline solutions in the range of about pH 2 to 14.

43. A building construction element as claimed in claim 2, wherein said construction element has the dimensions of formwork panel sheets of elemental formwork for the construction trade.

44. A building construction element as claimed in claim 1, wherein said construction element is fitted in girders of the form of timber formwork girders.

45. A building construction element as claimed in claim 1, further comprising a plurality of said construction elements welded to one another side by side.

46. A building construction element as claimed in claim 1, further comprising a plurality of sheets welded to one another side by side.

47. A building construction element as claimed in claim 1, wherein said construction element has a textured relief on one side.

48. A building construction element as claimed in claim 47, wherein said construction element is resistant to alkaline solutions in the range of about pH 12 to 14.

49. A process for the production of a construction element, comprising:

selecting a plurality of single, small, thin pieces of metal selected from the group consisting of aluminum foil and aluminum alloy and having a longest dimension that is less than the thickness of the construction element, combining said pieces of metal with plastic in a ratio of more than 50% by weight plastic and less than 50% pieces of by weight metal by weight, the construction element being comprised predominantly of plastic and pieces of metal, distributing said pieces of metal essentially evenly and oriented irregularly in said plastic, and forming said construction element with dimensions of formwork panel sheets of elemental concrete formwork and a thickness substantially less than at least one of its lengths and widths, such that the thermal transfer coefficient of said construction element is at least that of multilayer casting boards made of a plurality of layers of wood bonded by intermediate layers of plastic.

* * * * *